US005863038A

United States Patent [19]

Zoltner

[11] Patent Number: 5,863,038

[45] Date of Patent: Jan. 26, 1999

[54] PAPER FEED TRAY WITH ARTICULATING FINGERS TO ACCOMMODATE SMALL SIZED PAPERS

[75] Inventor: John D. Zoltner, Fairport, N.Y.

[73] Assignee: Xerox Corporation, Stamford, Conn.

[21] Appl. No.: 811,438

[22] Filed: Mar. 3, 1997

[51] Int. Cl.[6] ..... B65H 1/08

[52] U.S. Cl. ..... 271/127; 271/160

[58] Field of Search ..... 271/126, 127, 271/160, 167, 169, 4.08, 171

[56] References Cited

U.S. PATENT DOCUMENTS

| | | | |
|---|---|---|---|
| 3,586,317 | 6/1971 | Smitzer | 271/169 |
| 5,419,645 | 5/1995 | Russo | 271/160 |
| 5,553,528 | 9/1996 | Zoltner | 83/443 |
| 5,640,664 | 6/1997 | Ukei et al. | 271/160 |

FOREIGN PATENT DOCUMENTS

| | | | |
|---|---|---|---|
| 000571004 A2 | 11/1993 | European Pat. Off. | 271/160 |
| 610941 | 3/1935 | Germany | 271/126 |
| 0190126 | 10/1984 | Japan | 271/160 |
| 0056237 | 3/1987 | Japan | 271/127 |
| 406107342 A | 4/1994 | Japan | 271/127 |
| 406135579 A | 5/1994 | Japan | 271/160 |

*Primary Examiner*—H. Grant Skaggs
*Attorney, Agent, or Firm*—William A. Henry, II

[57] ABSTRACT

An adjustable, pivoting paper tray that enhances the feeding of a full ream of shorter than standard size paper by a feed roll from the paper tray without encountering stack normal force relief impediments includes a half ream sized adjustable backstop. The backstop has floating or articulating fingers resting on the ream of paper in the paper tray that slide downward as each sheet is feed from the paper tray. This movement of fingers allows every sheet to be fed from the sheet stack.

20 Claims, 3 Drawing Sheets

PAPER FEED TRAY WITH ARTICULATING FINGERS TO ACCOMMODATE SMALL SIZED PAPERS

BACKGROUND OF THE INVENTION

1. Field of the Invention

The present invention relates to an adjustable paper feed tray suitable for use in a desktop-size printing machine.

2. Description of the Prior Art

Generally, commercially available electrophotographic desk-top printers, as disclosed in U.S. Pat. No. 5,553,528 which are available at low cost are designed to output letter size pages. Of course, these printers have been used to make documents much smaller than a full-page size, such as, from about one-third to one-half the size of a full page. For example, some insurance applications require sending special 8 inch×7 inch mailer forms through a printer. As shown in FIG. 1, a prerequisite for feeding forms of this type from a full ream paper tray configuration which pivots at one end to a set of feed rollers or a feedhead at the other through the printer is to correctly stage a stack of these small preprinted forms by moving the backstop 52 of paper tray 18 to the right. However, since the tray is pivoted at pivot point 12, as paper tray 18 empties, backstop 52 will rotate up into the paper tray cavity and contact a frame member 53 thereby making the feeder inoperative for further feeding because the normal force supplied by spring 57 has been relieved between roller 56 and mailer forms 11. A conventional solution, as shown in FIG. 2, is to lower the top edge of a backstop 15 in order to clear the top of the tray. But, the problem with this solution is that lowering the top of the backstop reduces proportionately the paper supply stack height which in turn diminishes operator satisfaction since the operator is forced to replenish the paper supply twice as frequently. Therefore, the need remains for a simple device that facilitates the loading of a full ream of shorter than standard sized paper without encountering the above-mentioned problems.

SUMMARY OF THE INVENTION

According to one aspect of the present invention, there is provided an adjustable pivoting paper tray that enhances the feeding of a full ream of shorter than standard size paper by a feed roll from the paper tray without encountering stack normal force relief impediments. A half ream sized adjustable backstop is included that has floating or articulating fingers resting on the ream of paper in the paper tray.

and

Figure 6:
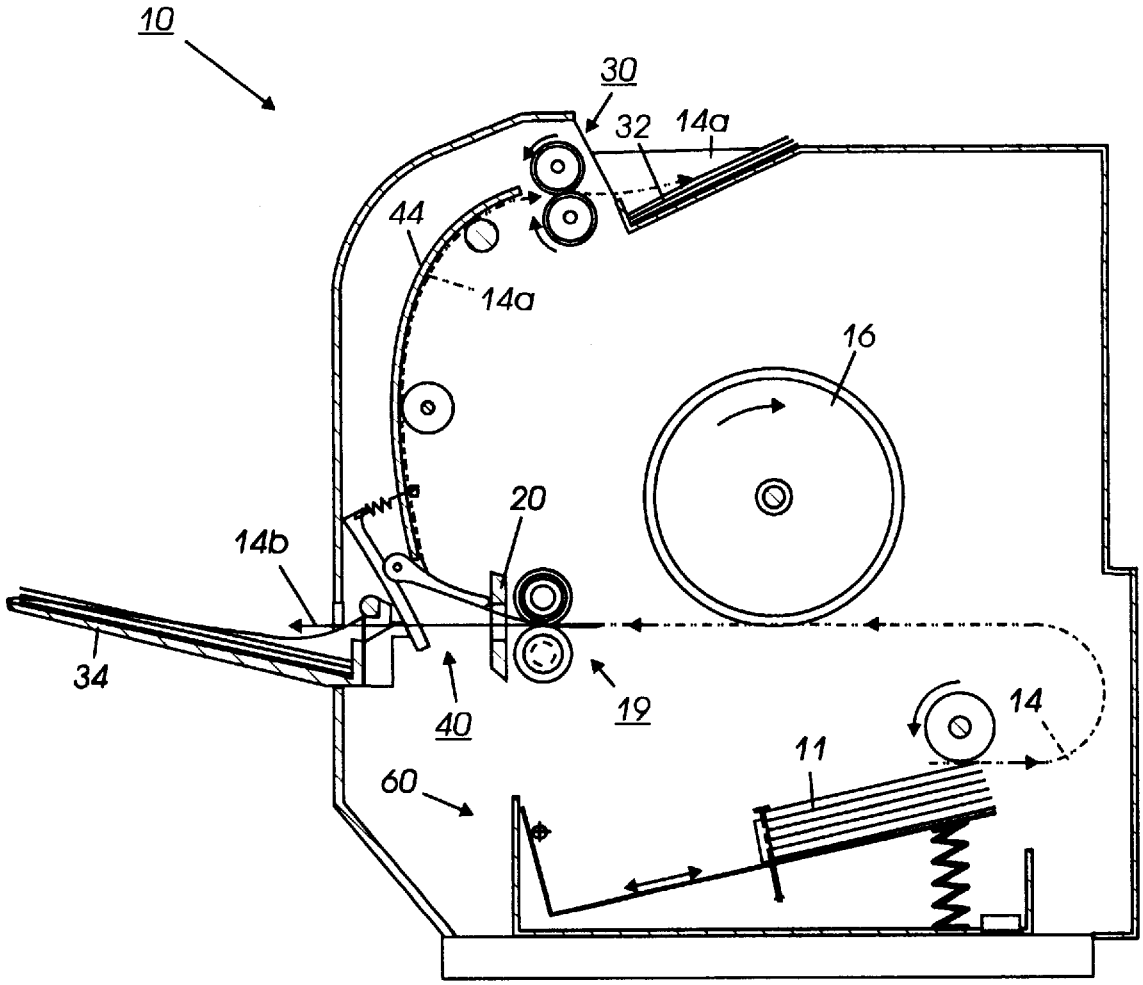

FIG. 6 is an enlarged, simplified, partial elevational view of a printer apparatus employing the pivoting paper tray in accordance with the present invention.

DETAILED DESCRIPTION OF THE PREFERRED EMBODIMENT

FIG. 6 shows the basic elements of a desktop-size page printer of a general design known in the art. The printing machine, generally indicated as 10, includes, among other image-forming components, a paper supply 11, from which is drawn sheets one at a time for the creation of images thereon. A sheet withdrawn from adjustable paper tray 60 is passed through path 14 past an image forming device in the form of, for example, a photoreceptor 16, the function of which is familiar to those skilled in the art of electrophotography. It will be apparent that the photoreceptor 16 could be replaced by, for example, an ink-jet printhead or other image forming device which creates images on a selected sheet in accordance with digital image data fed thereto. Also, a "printing machine" as recited in the claims could also refer to a light-lens copier. As shown in FIG. 6, the sheets are passed through a fuser 19 useful in electrophotographic printing, and then pushed through what is generally referred to as an output slot 20, which is here intended to mean simply the point along the paper path 14 after which the printed sheet would generally be accessible to a user.

Alternatively, the sheet can be selectably cut into smaller sheets, such as to form individual post cards, or to form checks and stubs, or the like as would be desired by a user. It will be noted that a portion of the paper path 14, here indicated as 14*a*, passes from output slot 20 and through the slitter 30, with the cut sheet being deposited in a top output tray 32. Sheets emitted from output slot 20 may be selectably controlled by diverter 40 as disclosed in U. S. Pat. No. 5,553,528 and sent along path 14*b* to land inside output tray 34 or path 14*a* to output 32.

Figure 1:
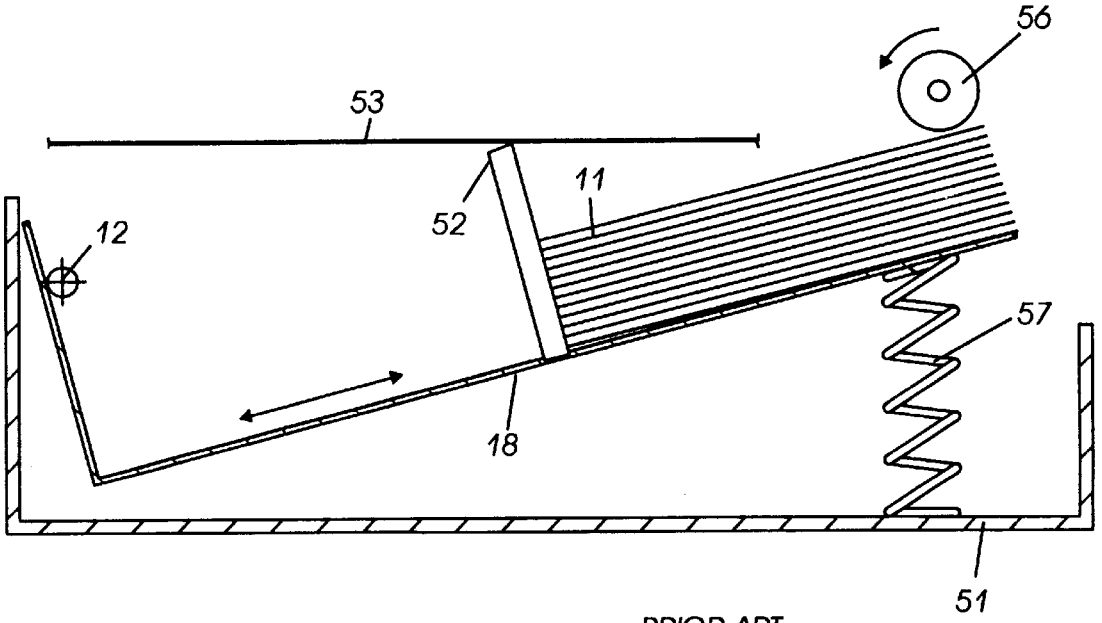
PRIOR ART FIG. 1
FIG. 1 is a partial, enlarged, simplified, elevational view showing a prior art pivoting paper tray with full ream backstop.
Figure 2:
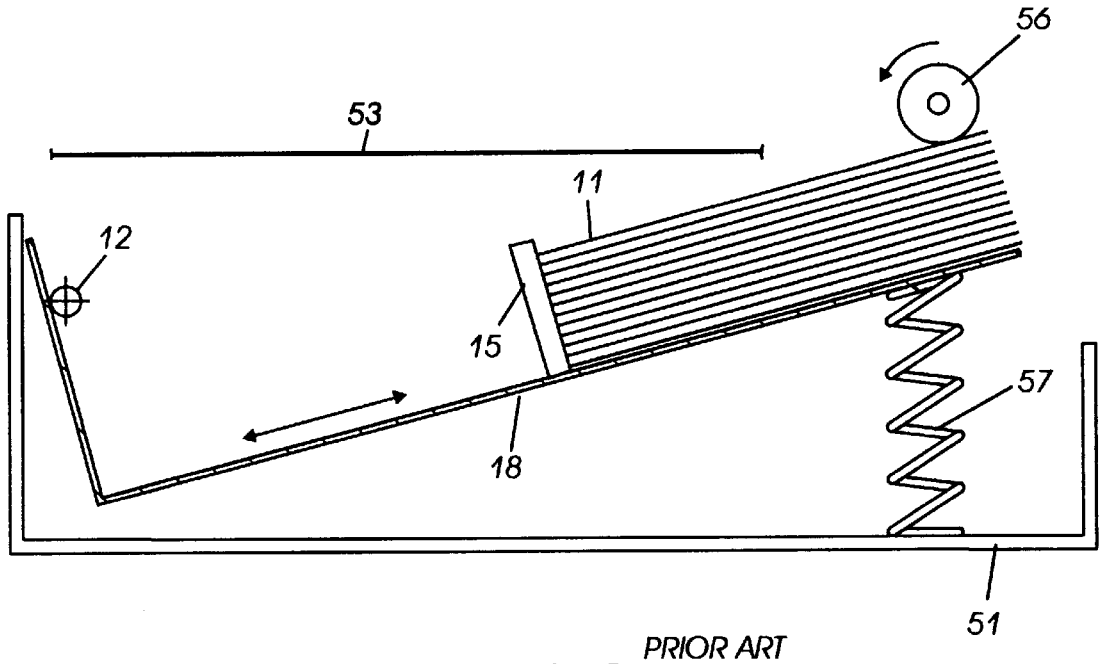
PRIOR ART FIG. 2
FIG. 2 is a partial, enlarged, elevational view showing the pivoting paper tray of FIG. 1 with a half ream backstop.
Figure 3:
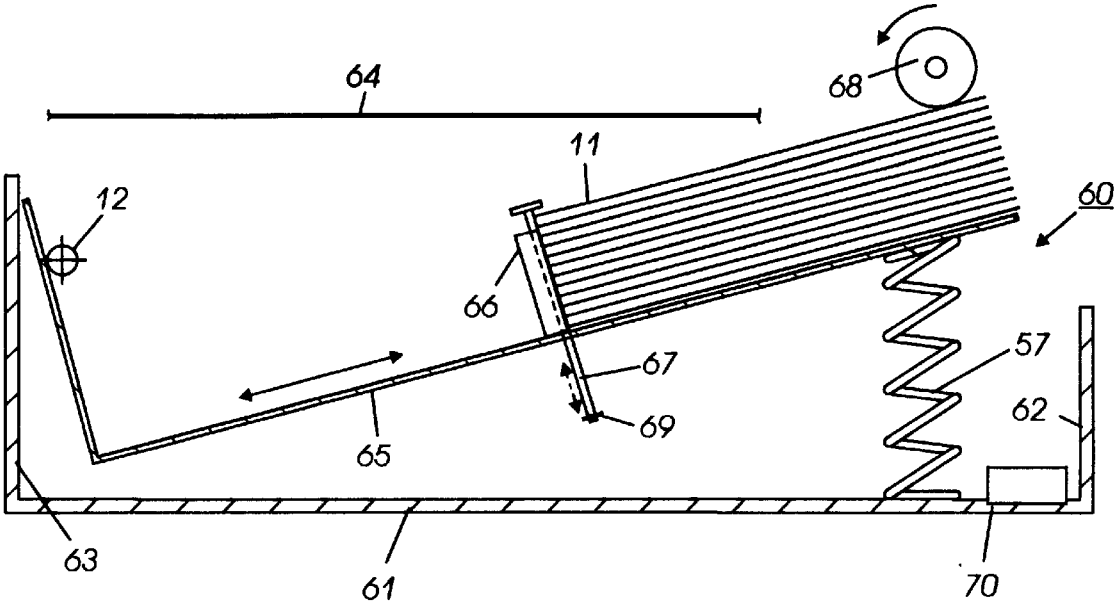
FIG. 3 is an enlarged, simplified, partial elevational view showing a pivoting paper tray that employs a half ream backstop with articulating fingers in accordance with the present invention.
Figure 4:
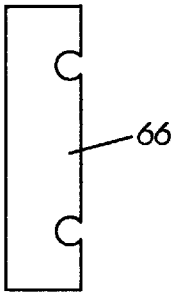
FIG. 4 is a top view of a drilled backstop for the articulating fingers of FIG. 3.
Figure 4A:
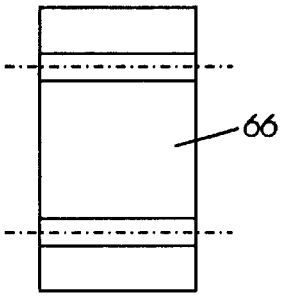
FIG. 4A is an elevational view of the backstop of FIG. 4.

According to a preferred embodiment of the present invention in FIG. 3, a pivoting paper tray 60 that enables the feeding of full reams of short sized paper from the tray is disclosed that includes a bottom frame member 61 bracketed by upstanding members 62 and 63 and a top frame member 64. A support platform 65 for supporting a ream of sheets 11 is structured to pivot about pivot point 12. A backstop 66 the height of a half ream of sheets is adjustable left and right as viewed in FIG. 3 to accommodate a variety of sheet sizes. In addition, to enable the feeding of a full ream of sheets of any size from sheet support 65, backstop 66 has holes drilled therein as shown in FIGS. 4 and 4A and includes independent acting floating or articulating fingers 67 positioned within the drilled holes. Fingers 67 sit on top of the ream of sheets, but slide downward slightly with each minute thickness of sheets as they are fed from support platform 65 by roller 68. The top of fingers 67 are hooked or headed like a common nail in order to rest on top of the sheet stack and an e-ring retainer 69 is positioned on the bottom end thereof.

In use, a spring 57 urges a ream of paper in the adjustable paper tray 60 upward into engagement with feed roller 68. Slidable backstop fingers 67 neatly descend downward into the bottom of the paper tray as sheets are feed from the sheet stack into paper path 14 within printer 10. To replenish the paper tray with a full ream of paper, a magnetic latch including two magnetic members 70 is used to hold the pivoting sheet support member 65 in its lowest position, which will automatically force the fingers upward so that an operator would not have to manually raise them when adding the ream of paper.

Figure 5:
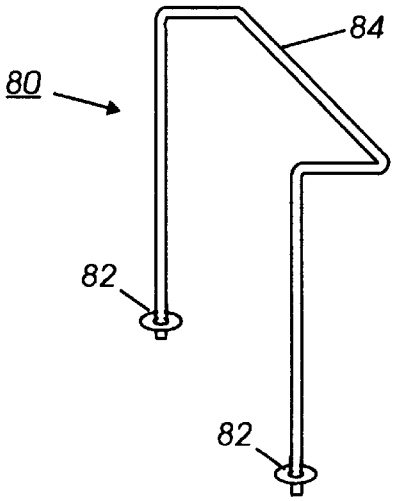
FIG. 5 is a perspective view of an alternative embodiment of the articulating fingers usable with the backstop in the pivoting paper tray of FIG. 3.

An alternative articulating finger is disclosed in FIG. 5 as comprising a one piece wireform floating finger 80 with two e-ring retainers 82. This finger will fit into the drilled holes in backstop 66 with orthogonal portion 84 extending over and resting on sheets 11. This finger too increments downwardly as each sheet is fed from tray 60. It should be understood that while a wireform floating finger is shown, the finger could be made of other materials including plastic.

In recapitulation, a pivoting paper tray is disclosed that pivots a paper stack upward to feed rollers, yet drops downward to avoids contacting the top of the paper tray cavity when the tray stack approaches approximately ¼ full. This is made possible by the use of articulating fingers that have a portion thereof riding on top of the sheet stack and recedes into the bottom of the sheet tray as the stack is depleted.

While the invention has been described with reference to the structure disclosed, it is not confined to the details set forth, but is intended to cover such modifications or changes as may come within the scope of the following claims.

I claim:

1. A paper tray, comprising:

a pivotable sheet support member for supporting a stack of sheets;

at least one feed roller, a member for providing normal force between the sheet stack and said at least one feed roller;

a backstop member positioned with respect to said pivotable sheet support member to support the end of the stack opposite said at least one feed roller; and a gravity acting guide associated with said backstop member and having a horizontal portion thereof positioned on top of the sheet stack and a vertical portion thereof positioned along a rear edge of the sheet stack, said guide being configured such that said vertical portion thereof slides downward within said backstop member and along a rear edge of the sheet stack as each sheet is fed from the sheet stack.

2. The paper tray of claim 1, wherein said guide comprises at least one finger.

3. The paper tray of claim 2, wherein said at least one finger has an upper end and a lower end with said upper end including a hooked portion and said lower end including a retainer member.

4. The paper tray of claim 3, wherein said member for providing normal force between the sheet stack and said at least one feed roller is a spring.

5. The paper tray of claim 1, wherein said guide comprises a pair of individual members.

6. The paper tray of claim 1, wherein said guide is a unitary, U-shaped member.

7. The paper tray of claim 6, wherein said unitary, U-shaped member includes a portion that is orthogonal with respect to the remaining portion thereof.

8. The paper tray of claim 7, wherein said unitary, U-shaped member is a wireform member.

9. The paper tray of claim 7, wherein said unitary, U-shaped member is a made of plastic.

10. An adjustable paper tray, comprising:

a container;

a pivotable sheet support member positioned within said container for supporting a stack of sheets;

a feed roller for feeding sheets from the sheet stack;

a member for providing normal force between the sheet stack and said feed roller;

a movable backstop positioned to abut sheets in the sheet stack at the end of the stack opposite said feed roller; and a gravity acting guide associated with said backstop and having a horizontal closed end portion thereof positioned on top of the sheet stack and a vertical open ended portion thereof configured to slide downward within said backstop member along a rear edge of the sheet stack as each sheet is fed from the sheet stack.

11. The paper tray of claim 10, wherein said guide comprises at least one finger.

12. The paper tray of claim 11, wherein said at least one finger has an upper end and a lower end with said upper end including a hooked portion and said lower end including a retainer member.

13. The paper tray of claim 12, wherein said member for providing normal force between the sheet stack and said at least one feed roller is a spring.

14. The paper tray of claim 10, wherein said guide comprises a pair of individual members.

15. The paper tray of claim 10, wherein said guide is a unitary, U-shaped member.

16. The paper tray of claim 15, wherein said unitary, U-shaped member includes a portion that is orthogonal with respect to the remaining portion thereof.

17. The paper tray of claim 16, wherein said unitary, U-shaped member is a wireform member.

18. The paper tray of claim 16, wherein said unitary, U-shaped member is a made of plastic.

19. A printing machine, comprising:

an image forming device, adapted to create an image on a sheet and output the sheet having the image thereon to a receiving tray;

a pivotable sheet support member for supporting a stack of sheets;

at least one feed roller;

a member for providing normal force between the sheet stack and said at least one feed roller;

a backstop member positioned with respect to said pivotable sheet support member to support the end of the stack opposite said at least one feed roller; and a gravity acting guide associated with said backstop member and having a horizontal portion thereof positioned on top of the sheet stack and a vertical portion thereof configured to slide downward within said backstop member along a rear edge of the sheet stack as each sheet is fed from the sheet stack toward said receiving tray.

20. The paper tray of claim 19, wherein said guide comprises at least one finger.

* * * * *